United States Patent [19]

Walker et al.

[11] 4,048,539

[45] Sept. 13, 1977

[54] APPARATUS FOR STARTING HIGH PRESSURE GASEOUS DISCHARGE LAMPS

[75] Inventors: Loren H. Walker; William P. Kornrumpf, both of Schenectady, N.Y.

[73] Assignee: General Electric Company, Schenectady, N.Y.

[21] Appl. No.: 582,840

[22] Filed: June 2, 1975

Related U.S. Application Data

[63] Continuation-in-part of Ser. No. 506,116, Sept. 16, 1974, abandoned.

[51] Int. Cl.[2] ..... H05B 41/231; H05B 41/24

[52] U.S. Cl. ..... 315/176; 315/239; 315/243; 315/277

[58] Field of Search ..... 315/174, 176, DIG. 2, 315/239, 243, 277; 313/184

[56] References Cited

U.S. PATENT DOCUMENTS

| | | | |
|---|---|---|---|
| 2,892,125 | 6/1959 | Warner et al. | 315/176 X |
| 2,951,971 | 9/1960 | Schultz | 315/277 X |
| 3,170,084 | 2/1965 | Retzer | 315/174 X |
| 3,235,770 | 2/1966 | Wattenbach | 315/243 X |
| 3,309,566 | 3/1967 | Michalski | 315/243 X |
| 3,575,630 | 4/1971 | Edris | 313/184 X |
| 3,732,460 | 5/1973 | Wattenbach | 315/243 X |

*Primary Examiner*—Palmer C. Demeo

*Attorney, Agent, or Firm*—Stephen B. Salai; Joseph T. Cohen; Jerome C. Squillaro

[57] ABSTRACT

Method and apparatus for start and hot restart of a high pressure arc discharge lamp includes the application of an AC ionizing potential to the lamp, the ionizing potential characterized by a period such that the electron density of the fill material of the lamp is increased on each half cycle of said potential until the lamp is started. The invention is disclosed in an integrated ballast, and in an addition to an existing conventional ballast.

1 Claim, 5 Drawing Figures

APPARATUS FOR STARTING HIGH PRESSURE GASEOUS DISCHARGE LAMPS

This application is a continuation-in-part of Ser. No. 506,116, filed Sept. 16, 1974, and now abandoned.

The present invention relates, in general, to arc discharge lamps and, in particular, to high pressure gaseous discharge lamps and methods and apparatus for starting such lamps while hot or cold.

High pressure arc dicharge devices, such as high pressure sodium lamps have wide commercial application, particularly because of their high efficiency, generally in excess of 100 lumens per watt. High pressure sodium lamps, i.e., having sodium vapor pressures in the range of several torr to about 8000 torr, require special starting and ballasting techniques. For examples, high pressure sodium lamps are normally started when cold by the application of a voltge pulse of a few microseconds duration and approximately 3000 volts amplitude. This pulse establishes an arc in a low pressure fill gas, such as xenon. When the lamp warms to operating temperature, the mercury-sodium amalgam in the arc tube partially vaporizes, forming a relatively high pressure mercury-sodium gas in the arc tube. This high pressure mercury-sodium gas becomes ionized and carries the arc current. However, should the lamp be momentarily extinguished for any reason, it can be restarted only by reionizing the high pressure gases which exist. Unfortunately the pulse source which starts the lamp when cold is not sufficient to ionize the high pressure sodium-mercury gas, so the lamp cannot normally be restarted immediately. After the lamp is allowed to cool for approximately 1 minute, the lamp can then be restarted with the normal pulse source.

Many lighting applications in which high pressure sodium lamps could be usefully employed cannot tolerate a one minute delay for restarting in the event of momentary extinction. Prior art attempts to restart high pressure sodium lamps have been generally directed toward applying pulses similar to those used for cold starting, but of substantially higher voltage. For example, pulse amplitudes on the order of 10,000 volts are required to establish an ionized channel in a high pressure sodium lamp. Such voltages generally cause a breakdown between the lamp lead wires where they enter the base connections to the lamp. These problems can obviously be overcome by suitable design of the lamp lead wires and the base connections. Unfortunately, such modifications are costly and hence unattractive for low cost lighting application.

It is therefore an object of this invention to provide a method and apparatus for restarting high pressure discharge lamps without the application of excessively high voltages.

It is a further object of this invention to provide a method of reionizing high pressure arc lamps while still at or near operating temperatures without costly modifications to existing lamps and fixtures.

It is a still further object of this invention to provide a method and apparatus for achieving normal starts and hot restarts of high pressure arc discharge lamps.

Briefly, these and other objects of my invention are achieved in accord with one embodiment thereof wherein initial ionization or reionization is provided by the application of a substantially undamped, alternating voltage having a period such that the level of ionization of the hot gas increases with each half cycle of said period. Typically, a high audiofrequency voltage applied for several milliseconds, a time long compared to the period of the voltage, causes lamp ionization or reionization while the arc gases are still at or near operating temperature. A "high audio frequency" as used in this disclosure includes frequencies in the ultrasonic range, as well as audible frequencies. Upon application of the high audio frequency voltage, ionization begins to occur and after a time which is long compared to the period of the ionizing voltage, an arc is struck and the voltage across the high pressure discharge lamp decreases substantially. Unfortunately, the arc voltage across the lamp may still be higher than that of the normal running lamp voltage source. Therefore, the high audio frequency source provides a follow-through current to the lamp of sufficient magnitude to increase the level of ionization and, hence, decrease the arc voltge until the running voltage source can begin to deliver the lamp power. In general, we have found that the minimum frequency of the ionizing potential is determined by the deionization time. Therefore, successful restarting of a high pressure discharge lamp is achieved by insuring that the half cycle period of the follow-through current is less than the deionization time constant of the high pressure discharge lamp so that the level of ionization increases with each half cycle of the ionizing potential.

Other objects and advantages of my invention will become apparent to those skilled in the art from the following detailed description, taken in connection with the accompanying drawings in which.

In order to more fully understand the operation of the present invention, it may be helpful to review briefly the starting characteristics of high pressure gaseous discharge lamps. Cold start of conventional high pressure lamps, such as a high pressure sodium lamp including mercury and an inert gas (e.g., xenon), is generally achieved by the application of a high voltage pulse of approximately 3,000 volts and 10 microseconds duration. This initiates an arc in the inert xenon fill gas which causes the temperature of the lamp to increase thereby causing first the mercury and then the sodium to vaporize. The mercury then ionizes and an arc is formed in it which replaces the xenon arc. As the temperature increases further, the sodium ionizes and the desired sodium arc is formed. Due to the fact that sodium ionizes more easily than mercury, although its evaporation temperature is higher, the sodium arc replaces the mercury arc as operating temperatures and pressures are reached. The presence of nonionized mercury in the plasma improves the efficacy and color of the sodium arc lamp.

In operation, the pressure in the arc tube of a high pressure sodium mercury lamp is relatively high, on the order of 1000 Torr, and the temperature is around 4000° K. Should the arc, for any reason, be extinguished, it is this combination of high pressure and high temperature which makes reionization of the sodium extremely difficult. For this reason, high voltage pulses which are adequate to start the lamp from a cold condition are inadequate to restart the arc in the high pressure, high temperature sodium environment. Where it has been desirable to restart high pressure discharge lamps of the type described from a hot condition, it has been the practice to utilize extremely high voltage, on the order of 10,000 to 50,000 volts, short-duration, pulses to break down the high pressure sodium gas. However, in order to prevent break down of the lamp or socket, it has been necessary to reconfigure the lamp as, for example, with the connections made to terminals at the ends thereof. In addition to the expense of replacing the lamp, the sockets and associated supports would necessarily have to be replaced. The present invention obviates these disadvantages.

Figure 1:
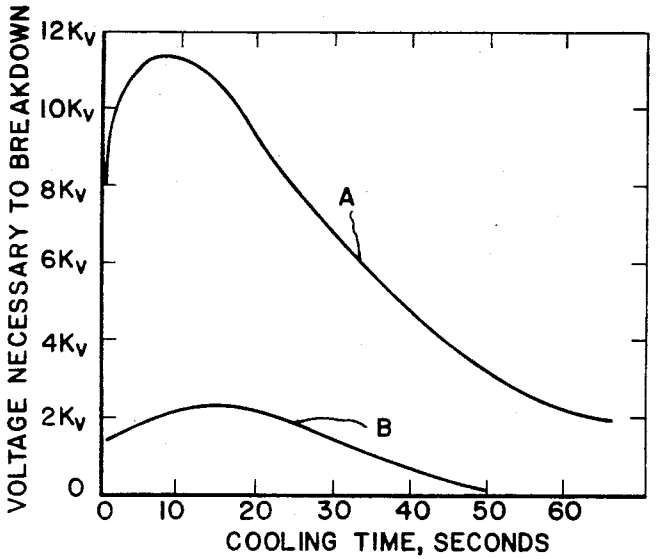
FIG. 1 is a graph of the relation between the minimum voltage required to restart a lamp and the time following extinction of the lamp.

FIG. 1 illustrates the relation between the required restarting voltage and the elapsed time from extinction (i.e., cooling time) of a conventional sodium-mercury lamp, for conventional pulse starting techniques, and in accord with the present invention. As the behavior of individual lamps, as well as that of the divers types of lamps to which this invention may be applied, varies widely, it is emphasized that the values shown are only approximate, and may vary over a wide range from type to type, and from lamp to lamp. The voltages shown on curve A are for conventional starting pulses on the order of a few microseconds in duration. Three periods are of special interest. During the first 300 microseconds or so, deionization occurs to a limited extent. It may therefore be possible to restart the lamp by the reapplication of normal operating voltage. During the period of approximately 300–600 microseconds following extinction, although the pressure remains high, sufficient ionization is still present that the application of a normal starting pulse will restart the lamp. During the period from approximately 600 microseconds to one minute following extinction the pressure remains high, and ionization has decreased to the extent that the normal starting voltage is insufficient to restart the lamp. After approximately 1 minute, the pressure has decreased to a low enough level that normal starting voltage will again be adequate to start the lamp. It is therefore the period between approximately 300 microseconds and 1 minute following extinction with which this invention is concerned. During this interval, it has been determined that the largest restarting voltage is required from 10–15 seconds following extinction of the lamp. Voltages in excess of 10,000 volts are commonly required. As these voltages exceed the breakdown voltages of the internal structure of the lamp and of its associated base and socket, they may not be utilized with presently existing lamps. The present invention overcomes these problems and provides a method for restarting a lamp during any portion of the above-mentioned cooling cycle, without exceeding the voltage levels conventionally utilized during cold starts.

Curve B of FIG. 1 shows the relation between the time following extinction (i.e., the cooling time) and the required voltage for restart of a conventional mercury sodium lamp in accordance with this invention. The voltage indicated is the RMS voltage of a constant amplitude sinusoidal waveform applied for a time long with respect to the deionization time constant of the lamp and should be regarded as typical. The maximum required voltage occurs during the same interval as the maximum required pulse voltage, i.e., 10–15 seconds following extinction. This maximum voltage is, however, significantly reduced from the pulse voltage previously required. In fact, in no case is a voltage required which exceeds the 3000 volt level of pulses conventionally used to cold start high pressure lamps of this type. Consequently, no reconfiguration of presently existing lamps is required to practice this invention.

Figure 2:
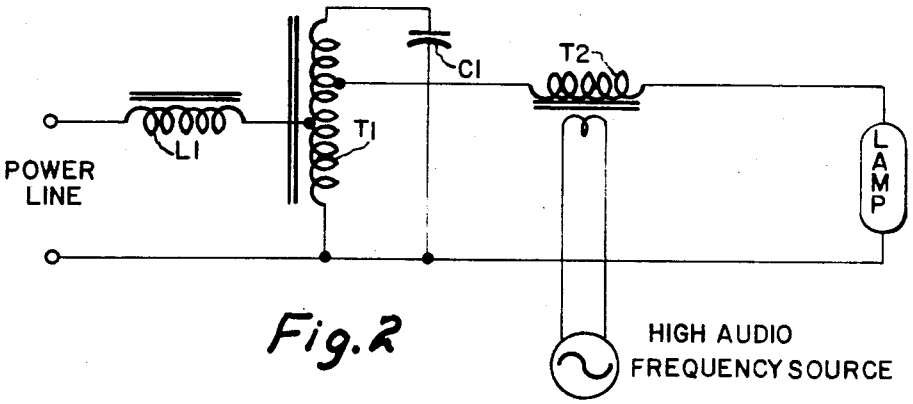
FIG. 2 is an electrical schematic diagram of electromagnetic ballast apparatus suitable for ionizing and reionizing a high pressure discharge lamp in accordance with one embodiment of the invention.

FIG. 2 is a schematic representation of a lamp ballast circuit in accordance with one embodiment of this invention. Inductor L1, autotransformer T1, capacitor C1, and transformer T2 comprise a standard lamp ballast circuit. Preferably, autotransformer T1 is a ferroresonant transformer so that relatively small variations in line voltage will not be reflected in ballast output. In operation, a line voltage such as 120 volts, 60 cycles, is applied to autotransformer T1 through series inductor L1. The stepped-up output voltage from transformer T1 is applied to the lamp through another series inductance, shown as the secondary of transformer T2. The secondary of transformer T2 provides a ballast impedance for operating the lamp from the stepped-up line frequency voltage. Conventionally, the primary of transformer T2 is connected to a source of high voltage short duration pulses (not shown). The turns ratio of transformer T2 is sufficient to step up the voltage of these pulses to levels adequate to cold start the lamp, on the order of 3,000 volts. Capacitor C1 serves the additional function of providing a low impedance shunt across autotransformer T1 for these short duration pulses thereby protecting the transformer from the high voltage pulses. Although the ballast so far described is conventional and has been described in a rather elemental form, the present invention does not depend upon any particular ballast design. Rather, it is only required that the ballast provide operating voltage and current to the lamp in a manner conductive to the mode of operation required, and that means for coupling short duration voltage pulses to the lamp be provided.

In accordance with the present invention, a source of high audio frequency voltage directly replaces the conventional pulse source connected to the primary of transformer T2, to provide both normal starts and hot restarts. While the application of high audio frequency voltages to existing pulse-transformer T2 will reliably start and restart the arc, it is preferable that a new transformer T2 be selected to most efficiently couple the audio frequency to the lamp, while continuing to provide the required ballast inductor function.

Obviously, a wide range of audio frequencies will effectively restart a hot lamp, however, a number of considerations will determine useful frequency ranges for individual lamp circuits. For example, for successful hot restart it is required that the period of the audio frequency voltage applied to the lamp be sufficiently short that the electron density of the high pressure gas increase over each successive half cycle of the audio frequency waveform.

It has been found that the deionization time constant of the plasma, that is, the time during which the level of ionization decreases to $1/e$ of its previous value, is approximately 300 microseconds. As a rough approximation, it may be stated that the half cycle period of the applied starting waveform may not exceed this value. A minimum frequency of approximately 1,600 Hertz is therefore indicated. It must be realized, however, that this minimum frequency is related to the peak-to-peak voltage of the applied waveform. If the voltage were very high, the portion of the cycle during which it would be less than the minimum voltage required to increase the level of ionization of a gas would be very small compared to a half cycle period.

It should also be noted that the shape of the waveform applied will affect the minimum frequency which may be used. A square wave of arbitrarily low frequency may be employed since there is effectively no time at which the energy delivered to the plasma is below the peak valve. For other waveforms, having ratios of peak to average voltage less than 1, minimum frequencies may be determined. It has been found that for a sine wave of 3,000 volts magnitude, 1600 Hz is a practical minimum. While square wves are ideal to restart the lamps, they are not so easily coupled to the circuit as other waveforms, as for example sine waves. Additionally, transformers to efficiently step up and coupled low frequencies to the lamp are necessarily bulky and expensive. In view of these consideration, it is preferable to use an a.c. voltage of higher than the minimum required frequency. Extremely high frequencies, on the order of 1 GHz, are not effective however, since polarity reversals will occur too rapidly to permit electrons to accelerate over a sufficient path length to develop sufficient energy to avalanche. Constraints not related to the functioning of this time impose a practical upper limit on the frequency of the restarting waveform well below the 1 GHz theoretical limit. The present state of the transformer art is such that power is most easily transferred to the ballast circuit at frequencies below 200,000 Hz due to core materials currently available. Additionally, electromagnetic noise considerations impose a constraint upon the upper frequency limit. Since the characteristics of an arc discharge lamp are non-linear, harmonics of the applied frequency will be generated. it is generally felt by those skilled in the art that frequencies below 60,000 Hz are preferably employed. As an additional lower frequency constaint, frequencies below 17,000 are audible to many persons. Since this invention may be practiced in environments where audible noise is objectionable, it is desirable that the frequencies employed be constrained to the ultrasonic range.

Figure 3:
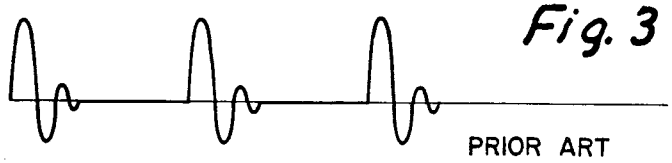
FIG. 3 is a waveform diagram of a typical prior art starting voltage.

Accordingly, in practicing the present invention, frequencies in the high audiofrequency range, i.e., between 1600 and 200,000 Hz are useful for starting and restarting most high pressure or discharge lamps, and frequencies between 17,000 and 60,000 Hz are preferably employed. Another requirement for hot restart of high pressure arc discharge lamps is based on the period of the high audio frequency waveform. In general, the period should be shorter than the deionization time constant of the lamp. This requirement is dictated by the peculiar start-up mechanism of high pressure arc discharge lamps. For example, the voltage required to reionize the hot lamp is initially very high. As the arc is formed, the voltage is substantially lower, but does not immediately drop to the normal operating voltage. In order to reduce the arc voltage below the open circuit ballast voltage, the condition which is referred to as "started," it is necessary that significant current be supplied to the lamp during the transition from the formation of the initial arc to the operating condition. The aforementioned starting requirements dictate, to a large extent, the characteristics for the high audio frequency voltage for the start and hot restart of high pressure arc discharge lamps. It is required that the voltage waveform applied to the lamp be substantially undamped in character. By this it is intended to mean that the envelope of the waveform be substantially undamped, as opposed to the highly damped pulse type waveforms known in the prior art. In prior art starting circuits the voltage level of the starting potential was set high enough to assure that breakdown occurred during the first cycle of the starting potential waveform. The magnitude of subsequent cycles of the starting potential was therefore not critical, and a highly damped waveform was suitable. This type of waveform is easily generated, and may be repetitive as shown, for example, in FIG. 3. Though the pulse is, in fact, shown to repeat, it should be recognized that starting of the lamp ultimately occurs on the first cycle of the waveform.

Figure 4:
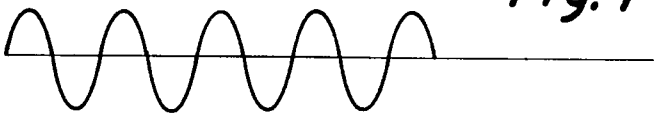
FIG. 4 is a waveform diagram of an exemplary starting voltage as a function of time according to this invention.

This invention discloses a method for starting and restarting high pressure discharge lamps which does not require or involve starting on the first cycle of the applied starting waveform. More typically, starting will occur after many hundreds or thousands of cycles of the applied waveform. The starting potential must, therefore, be maintained substantially undamped, that is, not substantially reduced in amplitude, for this period as shown for example in FIG. 4. The starting waveform of this invention may be of more or less arbitrary character so long as the envelope is maintained at a level above the level to provide ever increasing levels of ionization.

A wide variety of easily generated starting waveforms may be utilized in accordance with this invention so long as the aforementioned criteria for a substantially undamped envelope are fulfilled. For example, as has been hereinbefore described, sine waves and square waves may suitably be employed although it is recognized that these waveforms are idealized in form and will not be readily generated in a practical hot restart system in accordance with this invention. Therefore, it is to be understood that waveforms which deviate from these forms are equally well employed. For example, square waves which include ringing type overshoot on the leading and trailing edges thereof may be easily generated and are well suited to be employed in accordance with this invention. Further, a repetitive impulse type waveform as would be formed, for example, by the repetitive charging and discharging of an energy storage device as, for example, a capacitor provides a waveform ideally suited to be used in accordance with this invention. It must be remembered that the period of this repetitive waveform, that is to say the period between consecutive maxima must be maintained below the deionization time constant of the plasma. This is to be contrasted with the prior art method of hot restarting wherein repetitive pulses were, in fact, used but wherein the time between pulses was extremely long compared to the deionization time constant and the magnitude of the pulses was substantially greater than those utilized in the instant invention. It will be appreciated that there is no requirement that the high audio frequency waveform to be utilized in accordance with this invention be symmetrical and, in fact, nonsymmetrical waveforms may be preferred insofar as they are more easily generated.

High pressure arc discharge lamps generally are characterized by a negative resistance characteristic, i.e., as the current in the arc increases, the degree of ionization increases and more free electrons are available. As a result, the arc voltage is reduced. Therefore, in order to decrease the arc voltge below the open circuit ballast voltage, it is necessary to provide a source of current for the lamp after formation of the arc and before the normal operating voltage is reached. This current, referred to hereinafter as the follow-through current, may conveniently come from the starting circuit. Where a direct current is used to start the lamp, it is only necessary to insure that the follow-through current is available at sufficient voltage and for sufficient time so that the arc voltage reduces below the open circuit ballast voltage. However, where a high frequency voltage is used to start the lamp, it is necessary to insure that the period of the AC waveform is sufficiently short so that the electron density increases with each half cycle of voltage. In this way, the average lamp current will continue to increase with time, from cycle to cycle. As the arc current increases, the arc voltage consequently decreases. When the arc voltage is reduced below the open circuit ballast voltage, the lamp is considered to be started and the need for the starting voltage of whatever type is eliminated.

Figure 5:
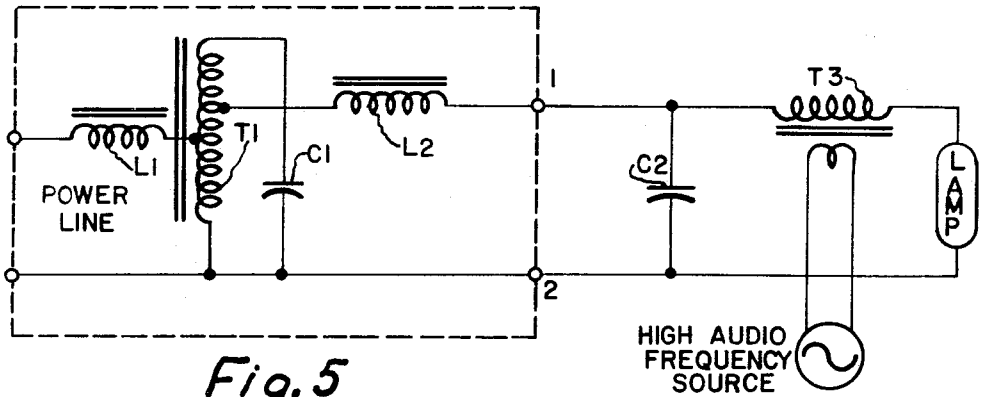
FIG. 5 is an electrical schematic diagram of a conventional electromagnetic ballast modified in accordance with the invention to provide hot restart of high pressure discharge lamps.

FIG. 5 illustrates the modification of a conventional ballast circuit for incorporating the hot restart feature of the present invention. The portion of the circuit enclosed by the dotted line is the conventional ballast circuit. While it is shown in a particular form, it is again emphasized that it may be treated as a "black box" having input terminals connected to a power line, and output terminals connected to a lamp, and a transfer function of any desired characteristics to run the lamp associated with it. Terminals 1 and 2 would conventionally be connected to the lamp to be powered. In accordance with this invention, additional elements, capacitor C2, transformer T3 and source of high audiofrequency voltage are added between the ballast and the lamp. Capacitor C2 is connected directly across the output of the conventional ballast. It is preferably selected to have a high impedance at the line frequency of the lamp arc sustaining voltage, and a low impedance at the high audiofrequency used to start the lamp. It presents a path for the starting voltage which shunts the existing ballast, while having little effect on normal operation. Transformer T3 is connected with the secondary thereof in series with the lamp and with the primary connected to a source of high audiofrequency voltage. The secondary of transformer T3 is preferably designed to have a low impedance at the line voltage frequency. The turns ratio of transformer T3 is selected to step up the voltage of the high audiofrequency source to a value sufficient to provide hot restart of the lamp.

The upper limit on the high audio frequency voltage is governed by the breakdown voltage of the lamp and its associated socket components. The greater the magnitude of the audio frequency voltage applied, the shorter the period required to restart the lamp, subject only to the breakdown constraints mentioned above. For example, it has been found that a voltage of 3000 volts RMS having a frequency of 25 kilohertz and applied for 40 milliseconds will reionize a hot lamp at any time following extinction. Similarly, a voltage from 10–30 kilohertz under similar conditions will provide reliable hot restart.

The invention as disclosed in this specification, as practiced by one skilled in the art, in accordance with the teachings herein offers significant advantages over the prior art. High pressure arc discharge lamps may be consistently started to restarted whether cold, or at or near operating temperatures, through the use of a high audio frequency voltage which in no instance exceeds in magnitude the conventional starting pulses hereinbefore used. The invention is suitable for incorporation into both new ballasts at the time of construction, or as a modification to presently existing ballasts. Existing high frequency ballasts are especially suited for modification in accordance with this invention to include reliable starting and instant hot restarting. From the foregoing it may be understood that ballasts operating in the high audio frequency range may be most readily and easily adapted to hot restarting by insuring that a sufficient starting voltage is available upon extinction of the lamp to provide increasing ionization on each cycle. Assuming a running voltage of 100 volts, an open circuit voltage of approximatey 30 times that value, or approximately 3000 volts would be preferred. Of course, the requirements for a substantially undamped waveform, and at a frequency sufficiently high to maintain an ever increasing level of ionization from cycle to cycle hereinabove discussed are applicable to high frequency ballasts in accordance with this invention.

While the invention has been particularly shown and described with reference to a preferred embodiment thereof, it will be understood by those skilled in the art that changes in form and detail may be made without departing from the spirit and scope of the invention. For example, for purposes of illustration and ease of description, the invention was described with reference to high pressure sodium lamps which also contain mercury and an inert gas, as for example xenon. The invention, however, is not limited to such lamps, and may be applied to other high pressure arc discharge lamps including, by way of example and not of limitation, mercury lamps, multivapor lamps, and other gaseous metal arc discharge type lamps known to those skilled in the art. Therefore, the appended claims are intended to encompass all such modifications and changes.

What we claim as new and desire to secure by Letters Patent of the United States is:

1. In a ballast system for a high pressure metal vapor arc discharge lamp including an ionizable gas in which the gas discharge has been extinguished, an improved means for restarting said lamp while the pressure of said lamp is on the order of 1000 Torr and the temperature is approximately 4000° K, said means comprising:

an inductor adapted to be connected to a low voltage, low frequency power source;

a ferro-resonant autotransformer connected to said inductor;

a capacitor connected in parallel with said autotransformer to provide parallel resonance at said low frequency;

a transformer having primary and secondary windings, said secondary winding connected in series with said autotransformer and said lamp;

means connected to said primary winding for applying a substantially undamped high audio frequency voltage of between 17,000 and 60,000 Hertz and of a magnitude sufficient to provide a voltage between 2500 and 4000 volts at said secondary winding for a sufficient time after extinction of said lamp and within 1 minute thereof to cause reionization of said gas and increase the level thereof until said lower frequency power source can maintain said ionization.

* * * * *